US005890308A

United States Patent [19]

Harrington

[11] Patent Number: 5,890,308

[45] Date of Patent: Apr. 6, 1999

[54] BASEBALL BAT STYLED GRAPHIC MATERIAL DISPLAY DEVICE

[76] Inventor: Kirk Douglas Harrington, 631 Conestoga Trail, Chanhassen, Minn. 55317

[21] Appl. No.: 792,342

[22] Filed: Jan. 31, 1997

[51] Int. Cl.[6] ..... G09F 3/18

[52] U.S. Cl. ..... 40/660; 40/661; 40/586

[58] Field of Search ..... 40/660, 586, 538, 40/661; 473/519, 326, 529, 516, 520, 564, 168, 169, 170; 446/267; 273/DIG. 14

[56] References Cited

U.S. PATENT DOCUMENTS

| | | | |
|---|---|---|---|
| 2,677,901 | 5/1954 | Tilleman | 40/660 X |
| 4,644,630 | 2/1987 | Blum | 29/453 |
| 5,452,889 | 9/1995 | Lewinski et al. | 473/519 |
| 5,487,203 | 1/1996 | Brach, Jr. et al. | 40/586 X |

FOREIGN PATENT DOCUMENTS

| | | | |
|---|---|---|---|
| 23113 | 7/1898 | United Kingdom | 40/660 |
| 2146538 | 4/1985 | United Kingdom | 473/169 |

*Primary Examiner*—Cassandra H. Davis
*Attorney, Agent, or Firm*—Roger W. Jensen

[57] ABSTRACT

A graphic material display device having a baseball bat-like shape. A centrally located shoulder and a second shoulder located adjacent one of the ends are connected by a web portion and support a transparent, hollow, cylindrical tube. Graphic material placed adjacent the web portion and within in the tube may be viewed through the tube.

12 Claims, 2 Drawing Sheets

(ALTERNATE)

BASEBALL BAT STYLED GRAPHIC MATERIAL DISPLAY DEVICE

BACKGROUND OF THE INVENTION

The field of this invention is motivational display and is especially applicable for use with children, adolescents and young people.

Motivational displays take many forms such as posters, banners, clothing articles, and typically some form of graphic for the motivational communication. One example in the field of athletics would be to have baseballs, basketballs, footballs, volleyballs and soccerballs (or replicas thereof) having a motivational display on the exterior surface thereof.

SUMMARY OF THE INVENTION

The present invention provides an apparatus which has a baseball bat-like shape and comprising in part a hollow, transparent cylindrical tube within which may be placed graphic material. More specifically, the present invention comprises an elongated cylindrical member with a baseball bat-like handle at one end thereof, a centrally positioned shoulder, and a second shoulder located at the other end. A web portion connects the two shoulders and the transparent, hollow, cylindrical tube is assembled with, and mounted on the member extending between the shoulders, the overall assembled member and tube having a baseball bat-like shape. Graphic material is placed adjacent to the web portion and within the tube. The graphic material may be planar or three dimensional.

DETAILED DESCRIPTION OF THE INVENTION

Figure 1:
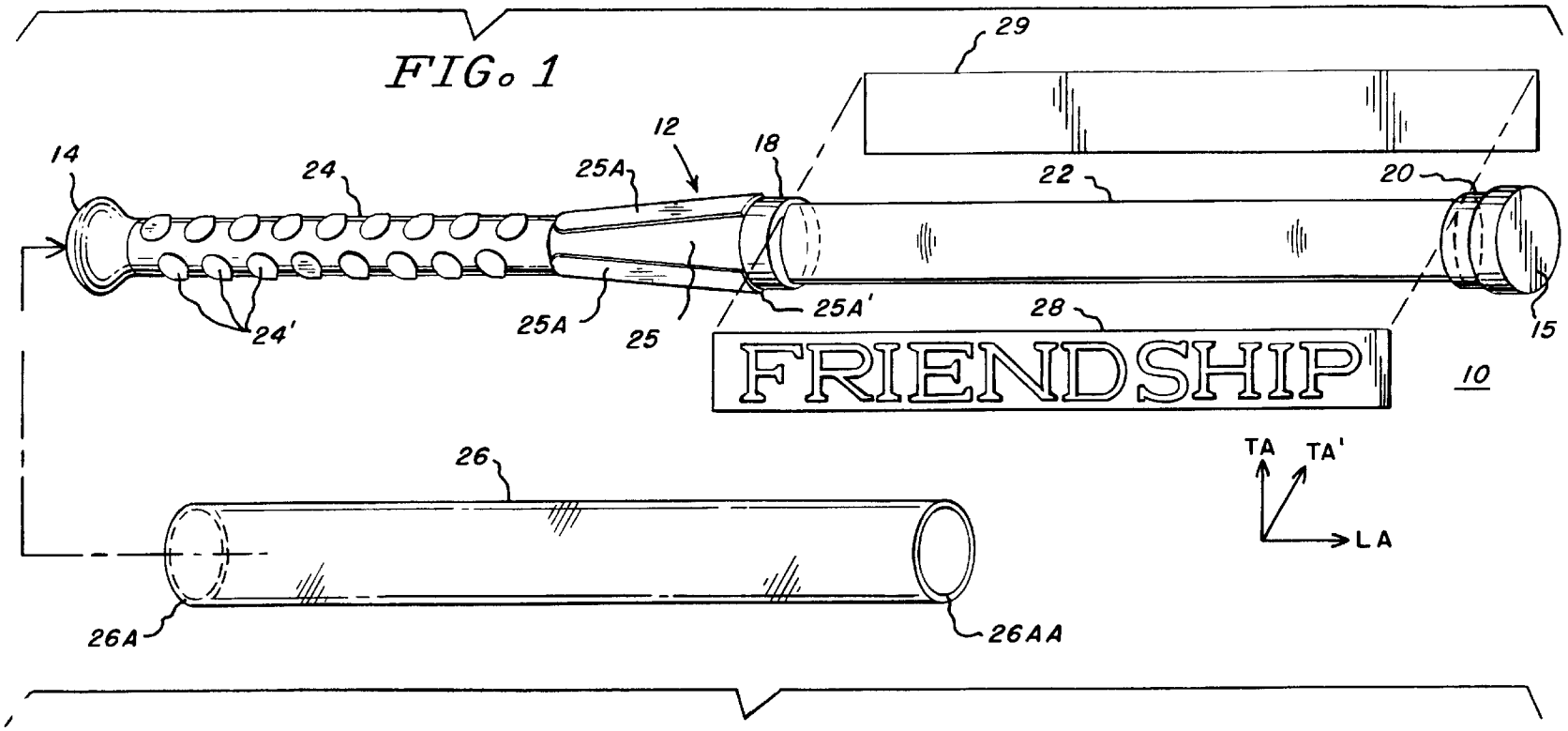
FIG. 1 shows an exploded isometric view of the preferred embodiment of my invention.
Figure 2:
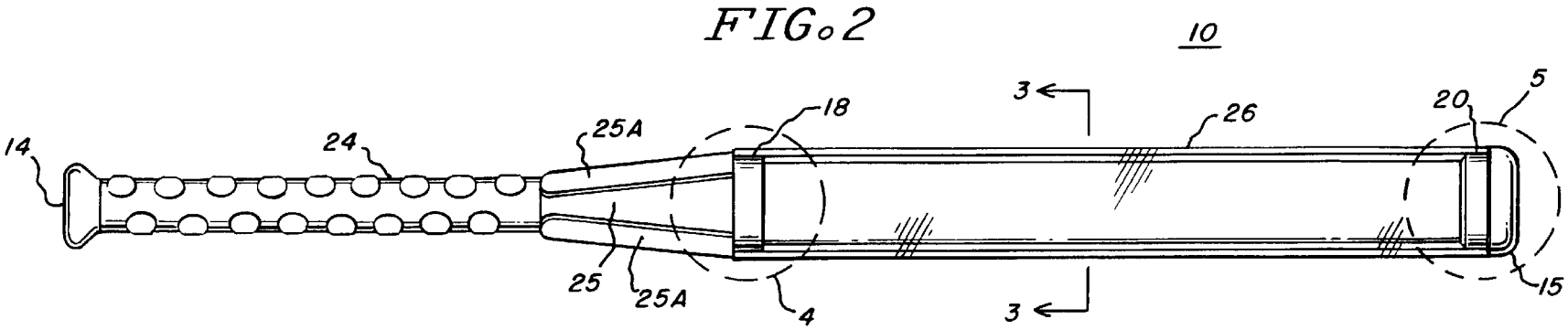
FIG. 2 shows a plan view of the device of FIG. 1.

Referring to FIGS. 1 and 2, the reference numeral 10 designates the overall graphic material display device having a baseball bat-like shape and comprises an elongated cylindrical member 12 having a longitudinal axis LA and a pair of mutually perpendicular transverse axes TA and TA'. Member 12 has two ends, 14 and 15, a centrally located shoulder 18, and a second shoulder 20, located adjacent end 15. Shoulders 18 and 20 have a circular cross-section with the same preselected diameter.

A web 22 is integrally connected between shoulders 18 and 20. In the preferred embodiment, the web 22 has a cross-section (see FIG. 3) which is somewhat oval or football shaped, i.e., has a dimension along transverse axis TA which is greater than the dimension along transverse axis TA'.

A baseball bat-like handle 24, also having a circular cross-section, is provided beginning at end 14 and extending toward the shoulder 18, up to a conically shaped portion 25 of member 12 intermediate the handle 24 and the shoulder 18 as is clearly shown in the drawings. More specifically, conically shaped portion 25 has a circular cross-section generally equal to that of handle 24 at its left end as depicted in FIGS. 1 and 2, and has a diameter substantially equal to the diameter of shoulder 18 at its right end as shown in FIGS. 1 and 2. Portion 25 has a plurality of longitudinally extending ribs 25A terminating at the right end thereof (as shown in FIGS. 1 and 2) with tube retaining shoulders 25A'. A plurality of round raised portions 24' are positioned circumferentially and logitudinally on handle 24.

Figure 5:
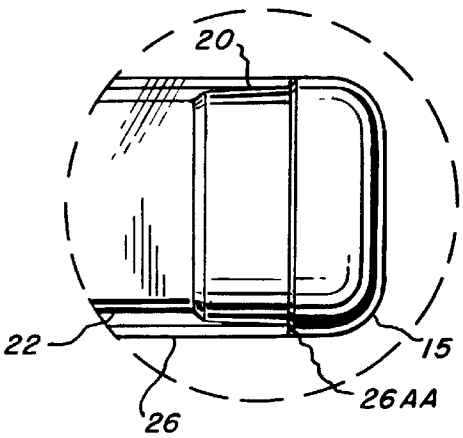
FIG. 5 is an enlargement of the other shoulder shown in the apparatus of FIG. 2.
Figure 4:
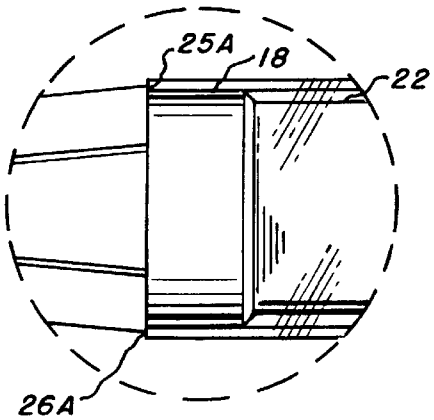
FIG. 4 is an enlargement of the central shoulder of the apparatus shown in FIG. 2.

An elongated transparent, hollow, cylindrical tube having a circular cross-section is identified by reference numeral 26; it has two ends 26A and 26AA and an inner diameter preselected so that the tube may be slid into the position shown in FIG. 2 in the following manner. The handle 24, as shown, has a diameter substantially less than the diameter of the shoulders 18 and 20. Tube 26 is therefore slid over the handle 24 and is pushed into the position shown in FIG. 2 by sliding up the longitudinal sloped surfaces 25A. The tube material preferably is of a suitable plastic which, in addition to being transparent, also has some inherent resiliency so that the tube may be assembled, as aforesaid, so that the end 26A of the tube is abutting the ends 25A' of the ribs 25 as is shown in FIG. 4. The other end 26AA of tube 26 is abutted against an inwardly extending shoulder of end 15 (see FIG. 5). Also shown in FIG. 5 is a slight taper on the circumferential surface of shoulder 20 so as to facilitate the insertion of the tube 26.

Figure 3:
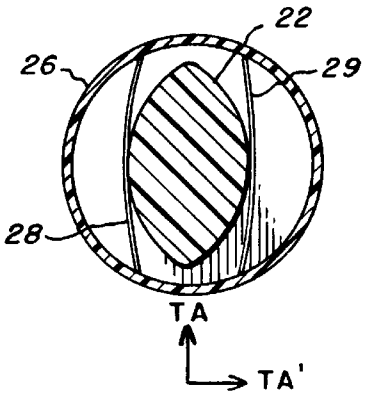
FIG. 3 is a view of the device as viewed along section lines 3—3 of FIG. 2.

Graphic material 28 and 29 (see FIG. 1) are shown to be elongated display strips on a suitable material such as paper or plastic, are adapted to be placed adjacent to the web portion 22 and inside the tube 26 whereby they may be viewed through the transparent tube. As shown in FIG. 3, the graphic material 28 and 29 are spaced apart by the web 22, the dimensions of the graphic material 28 and 29 being preselected with regard to the inner diameter of the tube 26 so that they are held firmly between the tube and the web.

While the graphic elements 28 and 29 as depicted are essentially planar, those skilled in the art will recognize that three-dimensional displays may also be used within the tube 26.

Figure 6:
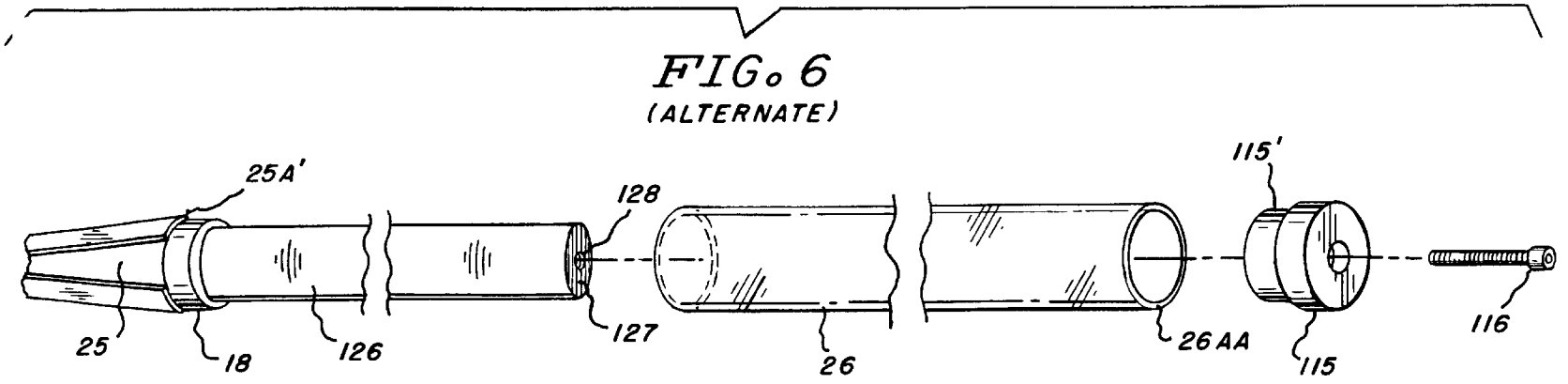
FIG. 6 shows an alternate construction of the invention.

FIG. 6 shows an alternate construction where all of the elements and portions are similar to the apparatus shown in FIGS. 1–5 except for a modified web 126 which terminates at an end 127 having a central tapped hole 128 for receiving a threaded machine screw 116 for attaching a removable end plug 115 having a shoulder 115' with a circular cross-section equal to that of shoulder 18. Thus the transparent tube 26 would be as before mounted on shoulder 18 and abutted against shoulders 25A' and end 26A thereof Appropriate graphic material, not shown, would be inserted between the web 126 and the inner periphery of the tube 26. Then the shoulder 115' of end piece 115 would be inserted into end 26AA of the tube 26 and the screw 116 would be threaded into threaded bore 128.

While several embodiments of the invention have been illustrated, it will be understood that variations may be made by those skilled in the art without departing from the inventive concept. Accordingly, the invention is to be limited only by the scope of the following claims.

I claim:

1. A graphic material display device comprising:

an elongated cylindrical member having a longitudinal and two mutually perpendicular transverse axes, two ends, a centrally located shoulder positioned between said ends, a second shoulder located adjacent one of said ends, a web portion connecting said shoulders, and an elongated handle extending from the other of said ends a preselected distance toward said centrally located shoulder; and a transparent, hollow, cylindrical tube assembled with and mounted on said member and extending between said shoulders whereby graphic material placed adjacent said web portion and within said tube may be viewed through said tube.

2. The device of claim 1 further characterized by (i) said tube having a circular cross-section with a preselected inner diameter, and (ii) each of said shoulders having a circular cross-section and a diameter preselected to be substantially equal to said inner diameter of said tube so that when said tube and member are assembled as aforesaid, said tube is supported at the ends thereof by said shoulders.

3. The device of claim 2 wherein said handle has a preselected diameter which is less than said preselected diameter of said shoulders.

4. The device of claim 3 wherein said tube is elastic.

5. The device of claim 1 wherein said web extends transversely and symmetrically with respect to said longitudinal axis.

6. The device of claim 5 wherein said web has a dimension along a first of said transverse axes substantially greater than the dimension of the web along the other of said transverse axes.

7. The device of claim 6 wherein said web has two display faces on opposite sides of said longitudinal axis and extending longitudinally between said shoulders.

8. The device of claim 7 wherein said two display faces have convex curved surfaces.

9. The device of claim 1 wherein said member has tube retainer means adjacent said centrally located shoulder.

10. The device of claim 9 wherein said retainer means includes a truncated conically-shaped portion connecting said handle to said centrally located shoulder.

11. The device of claim 10 wherein said conically-shaped portion has a plurality of longitudinally extending ribs.

12. The device of claim 1 wherein said second shoulder is removably connected to said web.

* * * * *